US006373478B1

(12) United States Patent
Steffensmeier

(10) Patent No.: US 6,373,478 B1
(45) Date of Patent: Apr. 16, 2002

(54) LIQUID CRYSTAL DISPLAY DRIVER SUPPORTING A LARGE NUMBER OF GRAY-SCALE VALUES

(75) Inventor: Martin J. Steffensmeier, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 09/277,524

(22) Filed: Mar. 26, 1999

(51) Int. Cl.[7] ..... G09G 3/36

(52) U.S. Cl. ..... 345/204; 345/87; 345/88; 345/89; 345/95; 345/98; 345/206; 345/210; 345/214; 348/790; 365/45

(58) Field of Search ..... 345/87, 88, 89, 345/95, 98, 147, 204–206, 210, 212, 214; 365/45; 348/790

(56) References Cited

U.S. PATENT DOCUMENTS 3,584,209 A * 6/1971 La-Garde ..... 235/183
4,114,995 A * 9/1978 Stieringer et al. ..... 352/171
4,335,393 A * 6/1982 Pearson ..... 386/10
4,639,867 A * 1/1987 Suzuki et al. ..... 378/98.12
5,347,201 A * 9/1994 Liang et al. ..... 315/366
5,977,942 A * 11/1999 Walker et al. ..... 345/97

* cited by examiner

*Primary Examiner*—Bipin Shalwala
*Assistant Examiner*—Vincent E. Kovalick
(74) *Attorney, Agent, or Firm*—Nathan O. Jensen; Kyle Eppele

(57) ABSTRACT

A column driver circuit for a liquid crystal display (LCD) system provides a large number of gray-scale values without significant cost, power requirements, and size requirements. The column driver circuit avoids the use of conventional multiplexer based systems and utilizes a digital-to-analog converter to provide voltage levels through analog memory devices. The analog memory devices are sample-and-hold circuits, each having two capacitors and three switches.

5 Claims, 3 Drawing Sheets

LIQUID CRYSTAL DISPLAY DRIVER SUPPORTING A LARGE NUMBER OF GRAY-SCALE VALUES

FIELD OF THE INVENTION

The present invention relates generally to a display driver for a visual display. More particularly, the present invention relates to a circuit that provides drive signals to a display.

BACKGROUND OF THE INVENTION

In general, it is desirous to provide more gray-scale capability to conventional flat panel displays. Gray-scale capability refers to the range from darkness to lightness for each pixel or element on a display. More gray-scale capability (e.g., more bits of gray-scale) are particularly important in avionic display systems and other high-definition viewing applications.

In conventional display systems, such as, liquid crystal display (LCD) systems, the brightness of each pixel or element is controlled by a transistor. The display includes a matrix of transistors, such as, thin film transistors (TFTs) arranged in rows and columns. A column line is coupled to the drain or source associated with each transistor in each column. A row line is coupled to each gate associated with the transistors in each row. A row of transistors is activated by providing a gate control signal to the row line. The gate control signal turns on each transistor in the row. Each transistor in the row provides an analog voltage associated with its column line to cause the pixel or element to emit a particular amount of light. Generally, a column driver circuit provides the analog voltage to the column lines so that the appropriate amount of light is emitted by each pixel or element. In conventional systems, the column driver circuit can typically provide approximately 8 or 16 levels of voltage at the column line (approximately 8 or 16 gray-scale levels).

Most conventional systems rely on a multiplexer-based column driver circuit to provide particular voltage levels. In such a scheme, a multiplexer includes a number of inputs, such as, 8 or 16 inputs. Each of the inputs is coupled to a different voltage level. Each voltage level is established by a resistive ladder or a resistive divider network or some other means. A control circuit selects a voltage level through the multiplexer and applies the voltage level as a gray-scale voltage signal to the column line. With such a scheme, one multiplexer is required for each column line. As displays include more columns, significantly more circuitry and power are required because a large multiplexer is required for each column.

Additionally, the multiplexer-based column driver not only requires larger size and more power when the gray-scale capability is increased, it is also more expensive. For example, in order to increase from a gray-scale capability having 16 levels to 64 levels, each multiplexer associated with each column must be increased in size, thereby increasing the size, cost, and power requirements of the driver circuit. Thus, there is a need for a display driver with increased gray-scale capabilities. Further still, there is a need for a column driver circuit for a liquid crystal display which provides more gray scales while using less power than conventional approaches which utilize a multiplexer-based structure. Further still, there is a need for a simplified column driver circuit for a liquid crystal display.

SUMMARY OF THE INVENTION

The present invention relates to a gray-scale voltage driver for a display having an array of transistors. The array includes a plurality of terminals receiving gray-scale voltage signals. The gray-scale voltage driver includes a plurality of analog memory devices, an analog voltage device, and a control circuit. The analog memory device have a memory input and a memory output. The memory output is coupled to a corresponding terminal of the terminals of the array. The analog voltage device has a voltage output. The voltage output is coupled to each memory input of the analog memory devices. The analog voltage device provides an analog voltage to the voltage output. The control circuit is coupled to the analog memory devices and controls the analog memory devices so the analog memory devices store the analog voltage at the memory input and provide the gray-scale voltage signals to the terminal.

The present invention further relates to a gray-scale voltage driver circuit for a liquid crystal display having an array of transistors arranged in at least a first row, a second row, a first column, and a second column. The transistors in the first column are coupled to a first column line. The transistors in the second column are coupled to a second column line. The gray-scale voltage driver circuit includes a first analog memory means for providing a first gray-scale voltage signal to the first column line, a second analog memory means for providing a second gray-scale voltage signal to the second column line, an analog voltage means for providing an analog voltage, and a control means for coordinating the provision of the analog voltage to the first and second analog memory means and the provision of the first and second gray-scale voltage signals.

The present invention still further relates to a method for providing gray-scale voltage signals to a liquid crystal display. The method includes providing a digital signal representative of an analog voltage signal, converting the digital signal to the analog voltage, storing the analog voltage in an analog memory unit, and providing the analog voltage from the analog memory device to the liquid crystal display as a gray-scale voltage signal.

BRIEF DESCRIPTION OF THE DRAWINGS

The present invention will hereafter be described with reference to the accompanying drawings, wherein like numerals denote like elements and.

DESCRIPTION OF PREFERRED EXEMPLARY EMBODIMENTS OF THE PRESENT INVENTION

Figure 1:
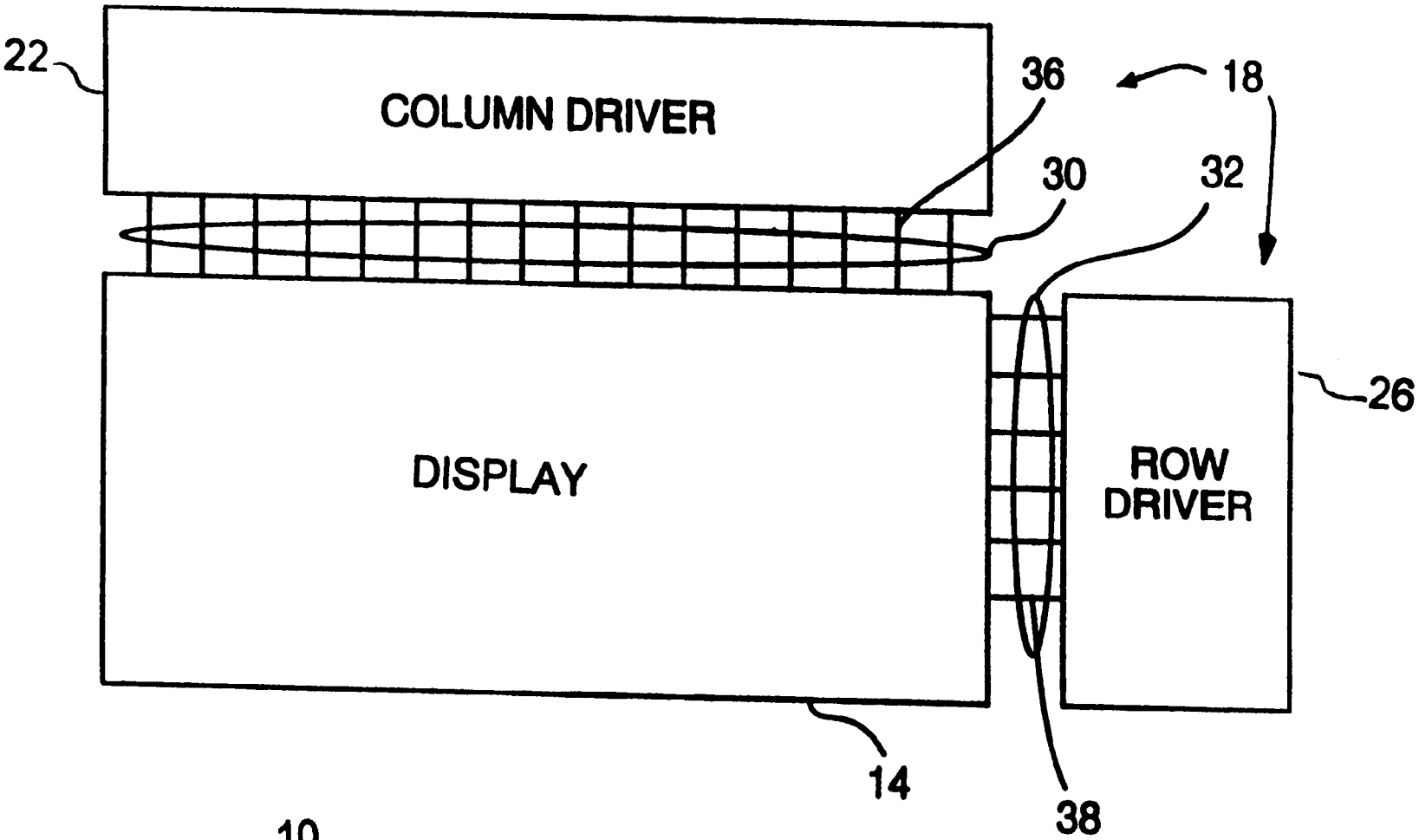
FIG. 1 is an exemplary block diagram of a visual display system including a column driver in accordance with the exemplary embodiment of the present invention.

With reference to FIG. 1, a display system 10, such as, a liquid crystal display (LCD), includes a display 14 and driver circuit 18. Driver circuit 18 includes column driver 22 and row driver 26. Driver circuit 18 provides electronic signals to cause display 14 to provide visual indicia. The visual indicia can be dynamic or static images. Display 14 is preferably a color-twisted nematic LCD having 640×480, 1024×768, 1280×1024 pixels. Each pixel can be comprised of three LCD elements, one for each color (e.g., red, green, and blue). The LCD can be a normally white or a normally black display.

Display 14 preferably includes an array of transistors, such as, thin film transistors (TFTs), provided over an LCD cell. The array of transistors is utilized to manipulate liquid crystals in display 14 to appropriately cause colors to be provided on display 14.

The transistors are arranged in rows and columns. The transistors have one drain/source coupled to a liquid crystal display element and the other drain/source coupled to a column conductor or line 36. The gate of the transistors are coupled to row lines 38. The column lines 36 are coupled to column driver 22 via bus 30. Row lines 38 are coupled to row driver 26 via bus 32. Bus 30 includes a separate conductor for each of lines 36. Bus 32 includes a separate conductor for each of lines 38. Row driver 26 turns rows of transistors on through signals provided across row bus 32 on row lines 38. When a row is turned "ON", voltages from column lines 36 are provided to the liquid crystal display cell. Depending upon the magnitude of the voltage on the column, the pixel or element associated with the transistor in the selected row and the selected column will emit a level of light. Column driver 22 and row driver 26 cooperate to ensure that the proper transistors emit the proper amount of light to create the visual indicia. For example, column driver 22 can provide voltage signals from zero to five volts at any number of voltage levels. Generally, the larger the number of different voltage levels, the greater the number of different levels of light (gray scales) that can be provided from the LCD element.

Column driver 22 advantageously utilizes less power and is smaller and less expensive than conventional column drivers which utilize a multiplexer for each column line. Display 14 is exemplarily shown having 6 rows and 16 columns. However, any number of rows and columns can be utilized. Column driver 22 advantageously uses an analog memory-based circuit which holds voltage levels for a small amount of time while they are applied to each of column lines 36. An analog memory cell which is significantly smaller than a multiplexer is associated with each column line. The memory cell includes two storage elements so the memory cell can be loaded with one voltage level, while applying another voltage level to the column line of lines 36. When the next row of transistors is actuated, the other storage element provides the voltage to the column line of lines 36, while the first storage element stores the next voltage level.

Figure 2:
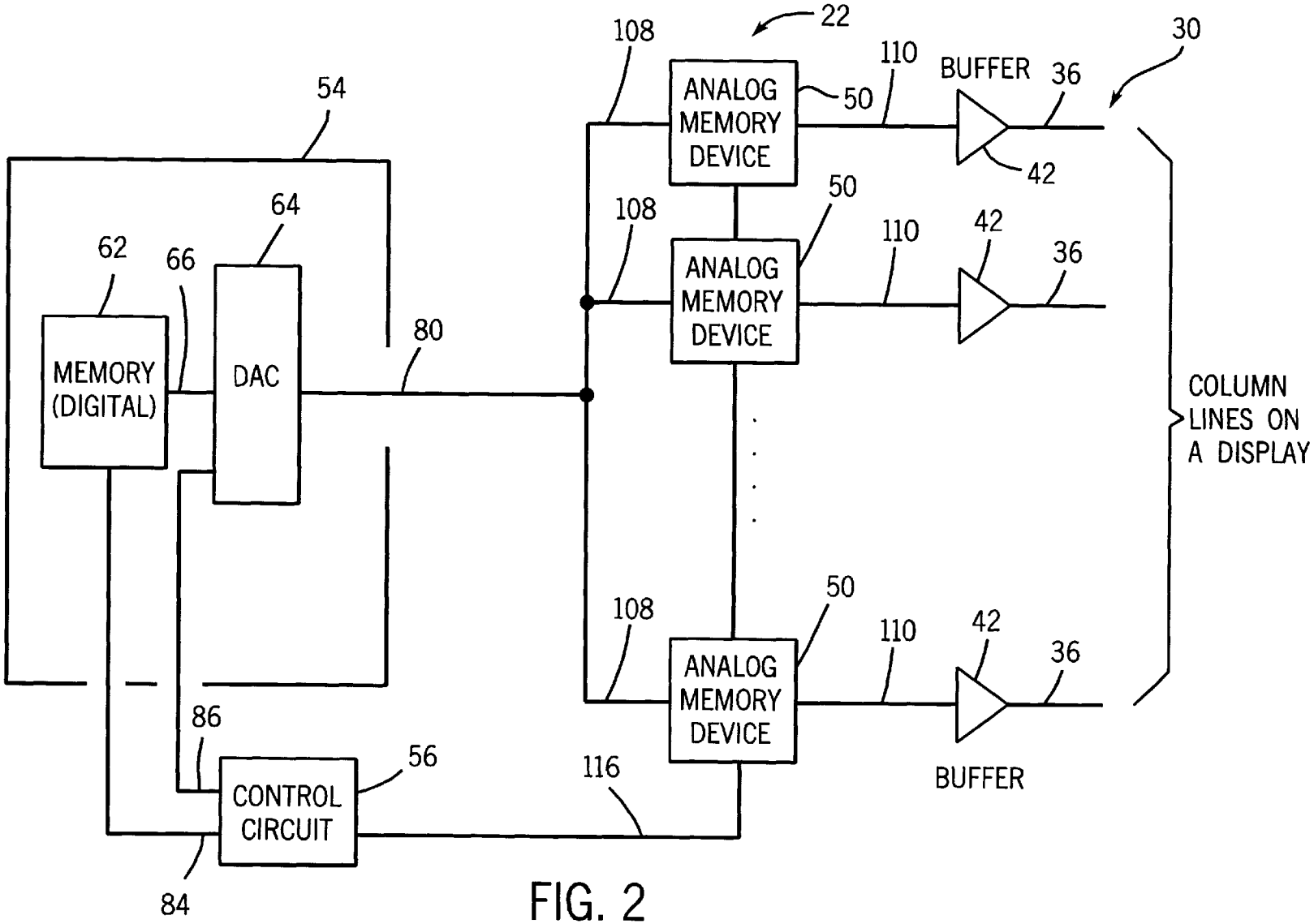
FIG. 2 is an exemplary block diagram of the column driver illustrated in FIG. 1, the column driver includes analog memory devices in accordance with yet another exemplary embodiment of the present invention.

With reference to FIG. 2, column driver 22 includes a voltage level generator or analog voltage device 54, a number of analog memory devices 50 (e.g., one per column line 36 associated with bus 30), buffers 42 (e.g., one per each column line 36), and a control circuit 56. Analog voltage device 54 provides an analog voltage at output 80 to inputs 108 of analog memory device 50. Analog memory devices 50 provide the analog voltage as a gray-scale voltage signal at outputs 110 to buffers 42. Buffers 42 provide the gray-scale voltage signal to column lines 36 across column bus 30 to display 14.

Analog voltage device 54 includes a digital-to-analog converter (DAC) 64 and a digital memory 62. Digital memory 62 provides a digital signal at output 66 to converter 64. Converter 64 converts the digital signal to an analog voltage level at output 80. Control circuit 56 includes an address and data bus signal 84 coupled to memory 62. Control circuit 56 also includes a control bus 86 coupled to converter 64. Control circuit 56 provides addresses to memory 62 so that memory 62 provides appropriate digital signals to digital-to-analog converter 64. Alternatively, device 54 can be a multiplexer bus circuit having an output 80 coupled to inputs 108.

Control circuit 56 controls the synchronization and operation of DAC 64 via control bus 86. Additionally, control circuit 56 includes a control bus 116 coupled to analog memory device 50. Control circuit 56 properly controls the reception and provision of signals by and from analog memory devices 50 so that appropriate grayscale voltage signals are provided to column lines 36.

Figure 3:
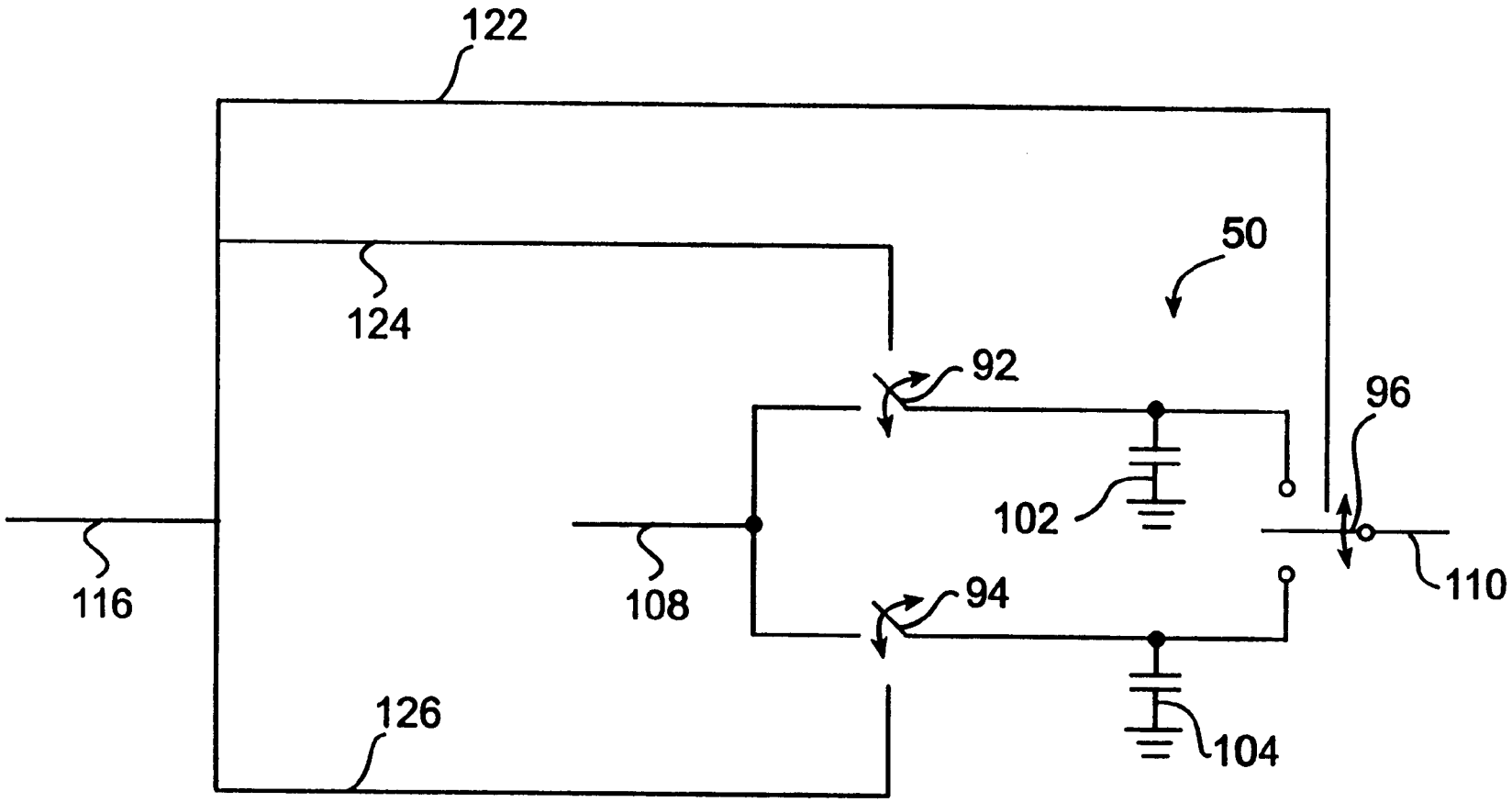
FIG. 3 is an electrical schematic drawing of the analog memory devices illustrated in FIG. 2, in accordance with still another exemplary embodiment of the present invention.

With reference to FIG. 3, analog memory device 50 includes an input 108, a first switch 92, a second switch 94, a third switch 96, an output 110, a first capacitor 102, and a second capacitor 104. Input 108 is electrically coupled, in parallel, to switches 92 and 94, which are single-pole, single-throw switches, such as, FETs. Switch 92 has a control input 124 coupled to control circuit 56 via control bus 116. Similarly, switch 94 is coupled to control circuit 56 through control line 126, via bus 116.

Switch 96, which is a single-pole, double-throw switch comprised of two or more FETS, is also coupled to control circuit 56 through control line 122. Switches 92 and 94 are each coupled to different terminals of switch 96. Switch 96 has another terminal which is also coupled to output 110.

Capacitor 102 is coupled between switch 92 and ground. Similarly, capacitor 104 is also coupled between switch 94 and ground. Control circuit 56 first stores a voltage level for application as a gray-scale voltage signal on capacitor 102 by closing switch 92 and by opening switch 94. Capacitor 102 is then charged to the level of the analog signal provided at output 80 of device 54. The voltage stored in capacitor 102 is then provided as the gray-scale voltage signal by opening switch 92 and coupling switch 96 to capacitor 102.

Additionally, switch 94 is closed after switches 92 and 96 are manipulated to store the analog signal provided at output 80 in capacitor 104. Alternatively, switch 94 can isolate capacitor 104 until device 54 provides the appropriate voltage level for the particular analog memory device 50. Once the voltage level is provided, switch 94 is closed, and capacitor 104 stores the voltage level until it must be provided to conductive line 36. The voltage level on capacitor 104 is then provided as the gray-scale voltage signal by opening switch 94 and closing switch 96 to capacitor 104. Alternatively, more than two capacitors can be utilized.

Control circuit 56 preferably optimally synchronizes operation of device 54 and of analog memory devices 50 so that analog memory device 50 simultaneously store charges from device 54 and provide charges to display 14. Capacitors 102 and 104 preferably have a value of greater than 1000 micro farads (MF) (but is dependent upon the load). Switches 92, 94, and 96 are preferably bilateral switches. Buffers 42 can be simple voltage follower-type amplifiers.

Driver circuit 18 and, more particularly, column driver 22 can be advantageously integrated on a single substrate. The operation of column driver 22 can be implemented by a processor-operating software, by a programmable logic device (PLD), or by an application-specific integrated circuit (ASIC). Control circuit 56 can utilize counters, timers, and other control circuitry for the operation for supervising, monitoring, and synchronizing operation of column driver 22. Additionally, column driver 22 can be partially or completely integrated with the display glass associated with a liquid crystal display, such as, display 14.

It is understood that, while the detailed drawings, specific examples, and particular component values given describe preferred exemplary embodiments of the present invention, they are for the purpose of illustration only. The apparatus and method of the present invention are not limited to the precise details and conditions disclosed. Single lines in the drawings can represent multiple conductors. For example, although an analog generation circuit including a digital-to-analog converter is discussed, other types of analog generation circuits can be provided. Additionally, although column driver 22 is shown directly coupled to display 14, it could be coupled to display 14 through a multiplexer in a hybrid configuration between the embodiment of FIG. 2 and conventional systems. In such a system, analog memory devices 50 would provide voltage levels to the inputs of the multiplexer, which would provide the gray-scale voltage signal to column line 36. Thus, changes may be made to the details disclosed without departing from the spirit of the invention, which will be defined by the following claims.

What is claimed is:

1. A gray-scale voltage driver for a display having an array of transistors, the array including a plurality of terminals receiving gray-scale voltage signals, the gray-scale voltage driver comprising:

a plurality of analog memory devices, each memory device having a memory input and a memory output, the memory output being coupled to a corresponding terminal of the terminals of the array;

an analog voltage device having a voltage output, the voltage output being coupled to each memory input of the analog memory devices, the analog voltage device providing an analog voltage to the voltage output; and a control circuit coupled to the analog memory devices, the control circuit controlling the analog memory devices so the analog memory devices store the analog voltage at the memory input and provide the gray-scale voltage signals to the terminals;

wherein each analog memory device includes at least a first switch, a second switch, a third switch, a first capacitor, and a second capacitor;

wherein the first switch is coupled between the memory input and the first capacitor, the second switch is coupled between the memory input and the second capacitor, and the third switch is coupled between the first capacitor and the second capacitor and the memory output;

wherein the control circuit controls the first switch, the second switch, and the third switch so the analog memory device can store the analog voltage in the first capacitor while providing a gray-scale signal of the gray-scale signals from the second capacitor to the corresponding terminal.

2. The gray-scale voltage driver of claim 1, wherein the analog voltage device includes a digital-to-analog converter.

3. The gray-scale voltage driver of claim 2, wherein the analog voltage device includes a digital memory having data outputs coupled to data inputs of the converter.

4. The gray-scale voltagle driver of claim 2, wherein the analog voltage device includes a control circuit having data outputs coupled to data inputs of the converter.

5. The gray-scale voltage driver of claim 1 further comprising:

a buffer coupled between the corresponding terminal and the memory output of each analog memory device.

* * * * *